US005110043A

United States Patent [19]

Ashby

[11] Patent Number: 5,110,043

[45] Date of Patent: May 5, 1992

[54] RETURN MAILER WITHOUT FLY SHEET

[75] Inventor: Robert E. Ashby, Quakertown, Pa.

[73] Assignee: Moore Business Forms, Inc., Grand Island, N.Y.

[21] Appl. No.: 701,070

[22] Filed: May 16, 1991

[51] Int. Cl.[5] ..... B65D 27/06; B65D 27/34

[52] U.S. Cl. ..... 229/304; 229/303; 229/314

[58] Field of Search ..... 229/316, 314, 306, 305, 229/304; 303, 71

[56] References Cited

U.S. PATENT DOCUMENTS

| | | | |
|---|---|---|---|
| 3,062,431 | 11/1962 | Rabenold . | |
| 3,312,385 | 4/1967 | Amort . | |
| 3,411,699 | 11/1968 | Pine et al. | 229/306 X |
| 3,436,009 | 4/1969 | Richardson | 229/71 |
| 4,190,162 | 2/1980 | Buescher | 229/314 |
| 4,334,618 | 6/1982 | Buescher | 229/314 |
| 4,403,696 | 9/1983 | Newell . | |
| 4,524,903 | 6/1985 | Buescher | 229/303 |
| 4,632,427 | 12/1986 | Angus | 229/69 X |
| 4,709,850 | 12/1987 | Wagner . | |
| 4,715,530 | 12/1987 | Leese et al. . | |
| 4,729,506 | 3/1988 | Neubauer | 229/71 X |
| 4,741,475 | 5/1988 | Norman | 229/69 X |
| 4,815,654 | 3/1989 | Buescher | 229/305 |
| 5,024,374 | 6/1991 | Ashby | 229/71 |

*Primary Examiner*—Stephen Marcus
*Assistant Examiner*—Jes F. Pascua
*Attorney, Agent, or Firm*—Nixon & Vanderhye

[57] ABSTRACT

A return mailer construction includes a first outer part, at least one intermediate part and a second outer part, wherein the first and second outer parts are used as both outgoing and return envelopes, the first outer part having a CB coating on at least a portion of an interior surface thereof, and at least one intermediate form part having a CF coating on at least a portion of a front face thereof. The first outer form part has an address window formed therein, a major portion of the window being separable from the first outer part upon opening of the mailer. The second outer part having a return envelope flap portion formed therein and foldable over at least a remaining portion of the address window in the first outer part. An alignment aperture is provided on the outer form part for alignment with a mark on the intermediate part, thereby insuring proper alignment of the form parts prior to impact printing variable information on the intermediate form part, through the outer form part. A related process is also disclosed.

24 Claims, 3 Drawing Sheets

RETURN MAILER WITHOUT FLY SHEET

BACKGROUND AND SUMMARY OF THE INVENTION

This invention relates to business forms in general, and to reusable return mailer constructions in particular.

While return mailer business forms constructions are themselves well known, the present invention provides an improved construction which eliminates the need of an outer fly sheet normally retained as a file copy and, at the same time, provides a unique, easy-to-use construction where the outgoing envelope portion of the mailer is also employed as the return envelope.

In typical return mailer constructions, a fly sheet is paper-locked along the marginal tractor feed edges as the outermost form part. This fly sheet carries a carbon backing or carbon spot in an address area aligned with the address area on the outgoing envelope cover sheet. At the same time, the outgoing envelope cover sheet may be carbon backed so that address information printed on the fly sheet will transfer not only to the outer surface of the outgoing mailer but also to the mailer insert directly beneath, or under, the cover sheet. Other information printed on the fly sheet will not appear on the outgoing envelope but will appear on the insert. Prior to mailing, the fly sheet is removed and retained as a file copy.

In one exemplary embodiment of this invention, a three-part mailer is provided which includes a first outer form part, an intermediate form part, and a second outer form part. As will be explained in greater detail below, the first and second outer form parts comprise the outgoing envelope and the intermediate form part comprises an insert provided with address, account and other printed information which may be utilized as a customer receipt, a remittance slip, or combination of the two. It will be appreciated that additional insert sheets may be included if desired.

The first and second outer form part include removable marginal edge portions as well as designated grasp and pull areas to facilitate opening of the mailer. In addition, the first outer form part is provided with a die cut window and a transparent patch covering the window for permitting visual access to address information provided on the intermediate form part or insert.

The first outer form part is also provided with a perforation line which extends between upper and lower edges of the form part and which extends through the die cut window and transparent patch.

The intermediate form part also incorporates separable marginal edge portions, but opposed upper and lower edges are formed by a conventional die cut technique which renders successive intermediate form parts within a continuous web discontinuous. This intermediate form part also contains in addition to the address information, a spot or other suitable indicia in a corner portion thereof which is designed to be aligned with a punch hole provided in the first form part. During the manufacture of the form, when the spot or other indicia is in vertical alignment with the punch hole, printing of the address information which will underly the die cut window in the first outer form part, as well as other information on the intermediate part, may be commenced.

The second outer form part is provided with a C-shaped glue pattern which in cooperation with the first outer form part, forms a pocket for both the outgoing and return envelopes. The second outer form part is also provided with a longitudinally extending fold line defining a fold-over flap for the return envelope. This flap is provided with a strip of rewettable adhesive to facilitate sealing of the return envelope.

When assembled, the form parts will be adhered by means of the glue strips provided immediately inside the separable marginal edge portions of the intermediate and first and second outer form parts, as well as by the additional glue strips provided on the second outer form part which adhere directly to the first outer form part.

The present invention also takes advantage of carbonless transfer techniques which are by now well known in the art. See, for example, U.S. Pat. Nos. 2,712,507; 3,016,308; and 4,199,174. In a typical carbonless arrangement, a top sheet will have its underside or back coated with an encapsulated solution of rupturable microcapsules containing a color precursor in fluid form (referred to as a CB coating) which reacts with a resin coating on the front of the underlying sheet (referred to as a CF coating).

In a preferred arrangement in accordance with this invention, the underside of the first outer form part will be provided with a conventional CB coating while the adjacent or upper surface of the intermediate form part will be provided with a CF coating, to thereby enable impact printing of variable information on the intermediate form part or insert through the first outer form part without that information also appearing on the outer form part.

In the designated address area of the intermediate form part, the CF coating may be overlaid with a CB coating to thereby provide a self-contained carbonless area, enabling impact printing of the variable address information onto the intermediate form part, through the transparent patch.

A similar self-contained spot is also preferably employed on the intermediate form part, underlying the previously described punch hole.

It will be appreciated, of course, that one or more additional windows could be provided in the outgoing mailer, with self-contained areas on the intermediate form part underlying the one or more additional windows, for the display of account numbers or other information.

Since the information printed on the form is typically accomplished by means of a printer connected to a computer, and since the use of a carbonless transfer system eliminates the need for protecting the outgoing envelope during impact printing, the previously employed fly sheet (file copy) can be eliminated.

After a recipient receives the mailer construction, it may be opened by pulling on the designated grasp and pull areas on the first outer form part. This results in a splitting or separation of the first outer form part along the longitudinally extending perforation line which extends through the die cut window and transparent patch. The intermediate and second outer form parts will separate along longitudinally extending perforation lines which lie inside the perforation lines defining the removable marginal edge portions.

Upon opening, the recipient will remove the intermediate form part and, after insertion of, for example, a remittance (with or without a remittance slip portion separated from the intermediate form part (or insert), the return envelope may be sealed by folding the second outer form part about the longitudinally extending fold line over the now abbreviated first outer form part to thereby provide the return envelope. In so doing, preprinted return address information provided on the original outgoing envelope now becomes the addressee information for the return envelope.

Thus, in accordance with the broader aspects of the invention, there is provided a return mailer construction comprising a first outer part; an intermediate part; and a second outer part; the first form part having a pair of side edges, an upper edge and a lower edge, and an address window formed therein; a first perforation line extending between the upper and lower edges across the window to define a first separable portion of the first outer part, removable upon opening of the mailer construction.

In another aspect, the present invention provides a return mailer construction comprising first outer part, at least one intermediate part and a second outer part, wherein the first and second outer parts are used as both outgoing and return envelopes, the first outer part having a CB coating on at least a portion of an interior surface thereof, and said at least one intermediate form part having a CF coating on at least a portion of a front face thereof; the first outer form part having an address window formed therein, a major portion of the window being separable from said first outer part upon opening of the mailer; the second outer part having a return envelope flap portion formed therein and foldable over at least a remaining portion of the address window in the first outer part.

The present invention also relates to a method of producing a return mailer having a first outer part, at least one intermediate part and second outer part, wherein the first form part is formed with an address window covered by a transparent patch for permitting visual access to an address printed on the intermediate part comprising;

a) providing an alignment mark on the intermediate sheet;
b) providing an alignment aperture on said first outer part;
c) aligning said mark and said aperture and, when aligned,
d) causing address information to be printed on said intermediate part through said transparent patch which will be visible through said window.

In another respect, the present invention provides a method of producing a return mailer comprising:

a) feeding a first outer form part from a storage drum to a first process unit where a window is die-cut in the first form part and a transparent patch is applied over the window;
b) feeding an intermediate form part from a second storage drum and passing the intermediate form part to a second processing unit where a self-contained carbonless spot is coated over a preprinted alignment mark in a corner of the intermediate form part as well as over the address area;
c) feeding a second outer form part from a third storage drum and passing the second outer form part to a third process station where glue lines are applied to the second outer form part including a rewettable glue strip to a return envelope flap portion of the second outer form part; and
d) joining the first outer form part, the intermediate form part and the second outer form part together downstream of the first, second and third processing station.

In addition to eliminating the need for a fly sheet, the present invention also provides a more professional looking form with greater confidentiality by reason of the window and transparent patch construction. The form also permits great flexibility by permitting an all carbonless transfer, or a combination of carbonless, carbonizing bond and/or tissue.

Other objects and advantages of the present invention will become apparent from the detailed description which follows.

DETAILED DESCRIPTION OF THE DRAWINGS

Figure 1:
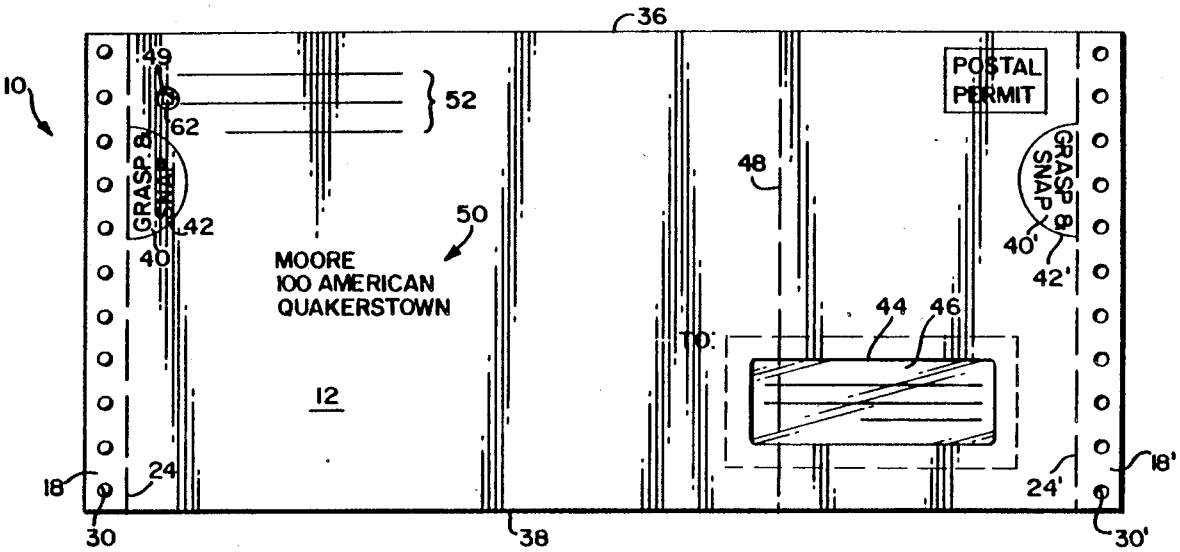
FIG. 1 is a top plan view of a return mailer in accordance with an exemplary embodiment of the invention.
Figure 2:
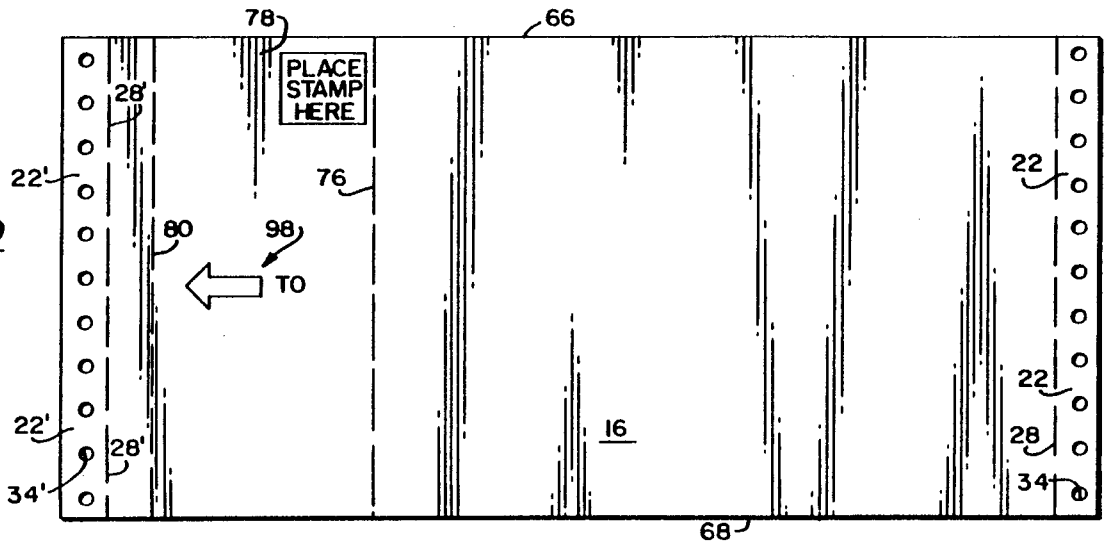
FIG. 2 is a bottom plan view of the return mailer illustrated in FIG. 1.
Figure 3:
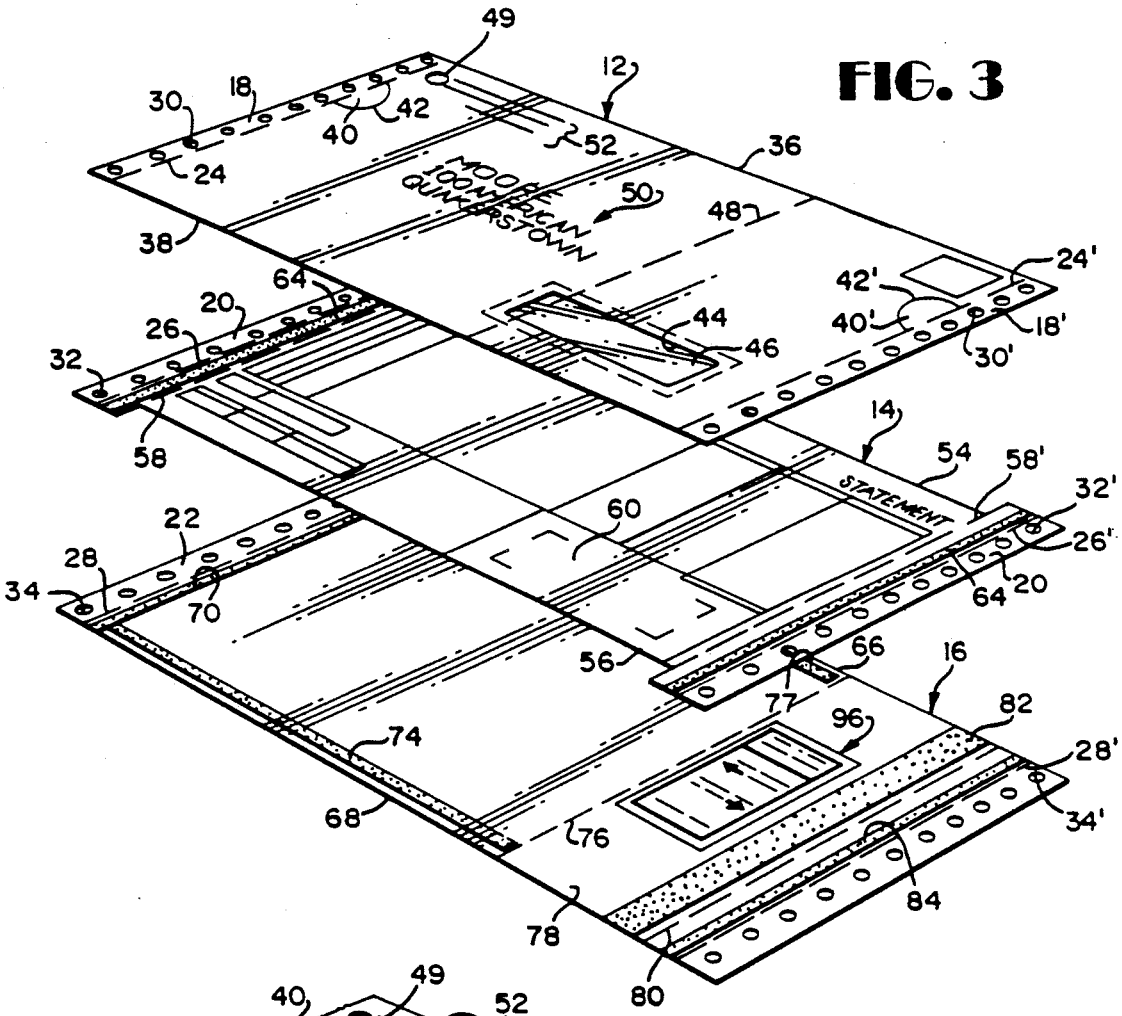
FIG. 3 is an exploded perspective view of the return mailer illustrated in FIG. 1.

Referring now to FIGS. 1-3 of the drawings, a return mailer form 10 in accordance with one exemplary embodiment of the invention comprises a first outer form part or sheet 12, an intermediate form part or insert sheet 14 and a second outer form part or rear sheet 16. Each of the form parts contains a pair of longitudinally extending marginal edge portions 18, 18', 20, 20' and 22, 22', respectively, as defined by respective pairs of longitudinally extending perf lines 24, 24', 26, 26' and 28, 28'. These marginal edge portions include rows of holes or apertures 30, 30', 32, 32' and 34, 34' which serve as conventional tractor feed holes in a continuous web system, as will be readily understood by those of ordinary skill in the art.

The first outer form part 12 is further defined by upper and lower edges 36, 38 which, during manufacture, are defined by transversely extending lines of perforation in a longitudinally continuous web, as will be readily understood by those of ordinary skill in the art. The outer form part 12 also includes a pair of "grasp and snap" areas 40, 40' defined by arcuate lines 42, 42', respectively, which join to the longitudinal perf lines 24, 24' on either side of the form part. The manner in which tab areas 40, 40' are utilized by a recipient of the form will be described in detail further below. The outer form part is also provided with a die cut window 44 covered by a transparent patch 46, adhesively secured to the underside of the form part 12.

An intermediate, longitudinally extending perf line 48 extends between upper and lower edges 36, 38 and across window 44 and patch 46.

The first outer form part 12 also includes an alignment punch hole 49 in an upper corner portion for a purpose also described in greater detail below.

Return address information may be pre-printed on form part 12 at 50 while blank lines 52 are provided for return address information to be applied when the initial recipient utilizes the mailer in a return mode. As will be explained further below, the return address information 50 in the outgoing mode becomes the addressee information in the return mode.

The intermediate form part or sheet 14 (one or more may be provided) is defined, by the marginal edge portions 20, 20' as well as by upper and lower die cut edges 54, 56. Those skilled in the art will appreciate that rectangular apertures may be die cut in successive intermediate sheets 14 along the continuous web to thereby render the intermediate sheets 14 discontinuous in length along the web (except for the marginal edge portions 20, 20').

Longitudinally extending perf lines 58, 58' lie inside the previously described lines 26, 26' and extend parallel thereto. Perf lines 58, 58' also define the transverse extent of the die cut edges 54, 56. As will be explained further below, the intermediate form 14 will separate along perf lines 58, 58' when the form is pulled at the grasp and snap areas 40, 40'.

The intermediate form 14 has a designated area 60 for receiving addressee information (other information, e.g., account information will be printed on the insert sheet 14 as well) as explained further below. The intermediate form part is also printed with an alignment mark 62 (see FIG. 1) seen through the alignment hole 48 on the first outer form part 12, as will also be described in further detail below.

A pair of glue lines 64, 64' extend longitudinally between perf lines 26, 58 and 26', 58' at opposite sides of the intermediate form part or insert 14, and serve to adhere the intermediate form part 14 to the first outer form part 12.

The second outer form part or rear sheet 16 is defined by marginal edge portions 22, 22' as well as upper and lower transverse edges 66, 68. As with the first outer form part 12, edges 66, 68 may be formed from transversely extending perf lines within the continuous web.

The rear sheet 16 is provided with a C-shaped glue pattern including a longitudinally extending glue line 70, inwardly adjacent perf line 28 and transversely extending glue lines 72, 74 which lie adjacent and parallel to the upper and lower edges 66, 68.

Glue lines 72, 74 terminate in the right-hand direction adjacent a longitudinally extending fold line 76. A return envelope flap 78 is defined between the fold line 76 and a longitudinally extending perf line 80 which lies laterally inwardly of the marginal perf line 28'. A strip of rewettable glue 82 extends between upper and lower edges 66, 68 adjacent perf line 80, while a longitudinally extending glue line 84 lies between and parallel to the perf lines 80 and 28'.

Glue lines 72, 74 will adhere the second outer form part 16 directly to the back face of the front form part 12 by reason of the die cut or offset edges 54, 56 of the intermediate form part 14. These glue lines, in cooperation with glue lines 64 and 70, form an envelope pocket for both the outgoing and return envelopes. The second outer form part 16 is secured along the left hand margin to the intermediate form part 14 via the longitudinal glue line 70. At the same time, intermediate form 14 is secured to the first outer form part 12 along the same left hand margin by glue line 64. Glue lines 64, 64', 66, 68, 70 and 84 may be any conventional heat or pressure activated adhesive composition.

The return envelope flap portion 78 may include instructions or other indicia 96 explaining to the initial recipient how to use the return envelope. At the same time, a major portion of the inside surface of the second outer form part 16 may, i.e., the surface to the left of perf lines 76, be printed with a block-out pattern to prevent visual inspection of the contents of the return envelope.

In a preferred arrangement, the underside of form part 12 will include a CB coating while the upper surface of form part 14 will include an CF coating so that information can be printed on the upper surface through the form part 12 with, e.g., a ribbonless typewriter or printer. The address area 68 of form part 14 will be "self-contained", i.e., it will have a CF coating covered by a CB coating (or a mixture of the two), so that the address information can be added by an impact printing device, through the transparent window 52. Similarly, the spot on form part 14 beneath aperture 49 can also be self-contained. It will be appreciated that while the above arrangement is preferred, others are equally viable, i.e., any combination of carbonless and carbonizing bond and/or tissue may be employed.

In use, the mailer may be distributed with or without marginal edge portions 20, 20', 22, 22' and 24, 24' included. The recipient grasps the mailer construction at the grasp and snap areas 40, 40' and pulls the form in opposite directions. This will result in the first outer form part 12 being split along the longitudinally extending perforation line 48 extending across the transparent patch 46 covering the window 44. At the same time, the intermediate form part 14 will separate along the longitudinally extending perf lines 58, 58' while the second outer form part will separate only along the longitudinal perf line 80. While this "grasp and pull" technique is preferred, other conventional arrangements for opening the mailer may be used.

Figure 4:
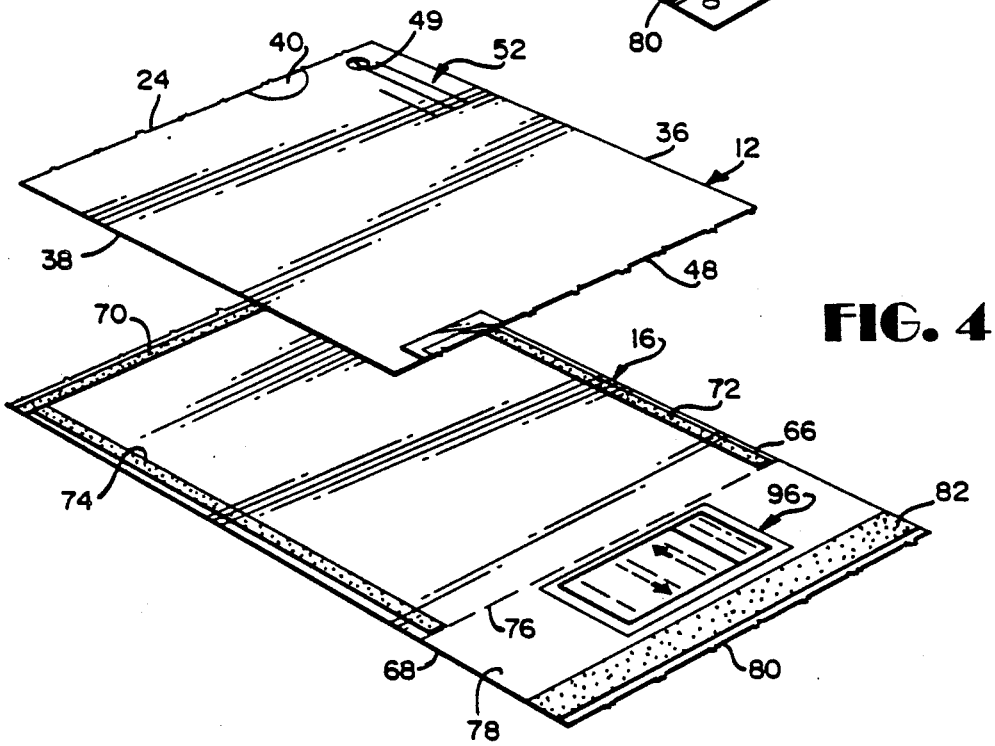
FIG. 4 is an exploded perspective view of the return mailer illustrated in FIG. 1, in a return mode, with intermediate sheet removed.

Upon removal of the intermediate form part 14, which may be retained as a record by the recipient, the user is left with a return envelope construction shown in exploded form in FIG. 4 with the front side thereof terminating along an edge defined by perf line 48. Upon insertion of, for example, a remittance, into the return envelope pocket, the second outer form part or rear sheet 16 may be folded about the line 76 so that the return envelope flap portion 78 will overly, and be adhered to, an outer surface of the first outer form part 12 with the utilization of the rewettable adhesive strip 82, as best seen in FIG. 4.

Figure 5:
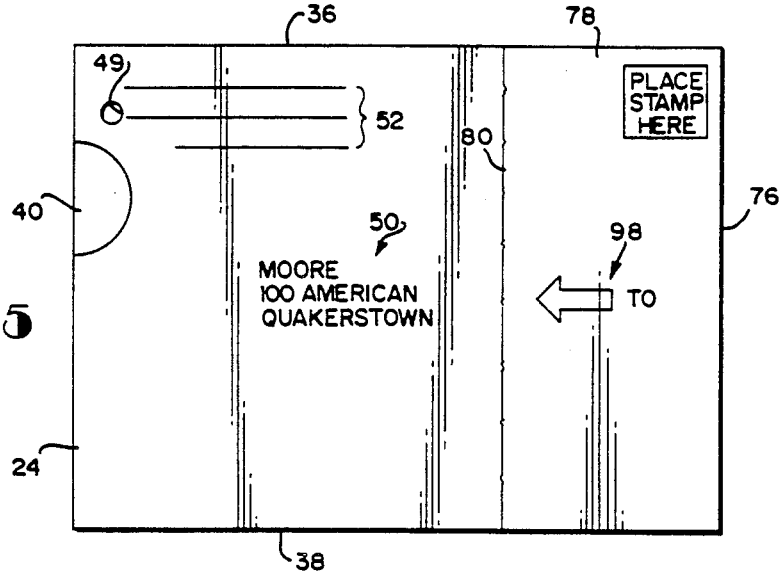
FIG. 5 is a top plan view of the return mailer illustrated in FIG. 1, in a return mode.

The indicia 50 provided as a return address for the outgoing envelope as shown in FIG. 1 now becomes the addressee information for the return envelope as shown in FIG. 5. In order to be certain that the postal system understands that the information 50 pertains to an addressee, a suitable indicia such as the directive shown at 98 may be provided on the back side of the second outer form part 16. The blank lines indicated at 52 may then be filled in by the original recipient with a return address.

Figure 6:
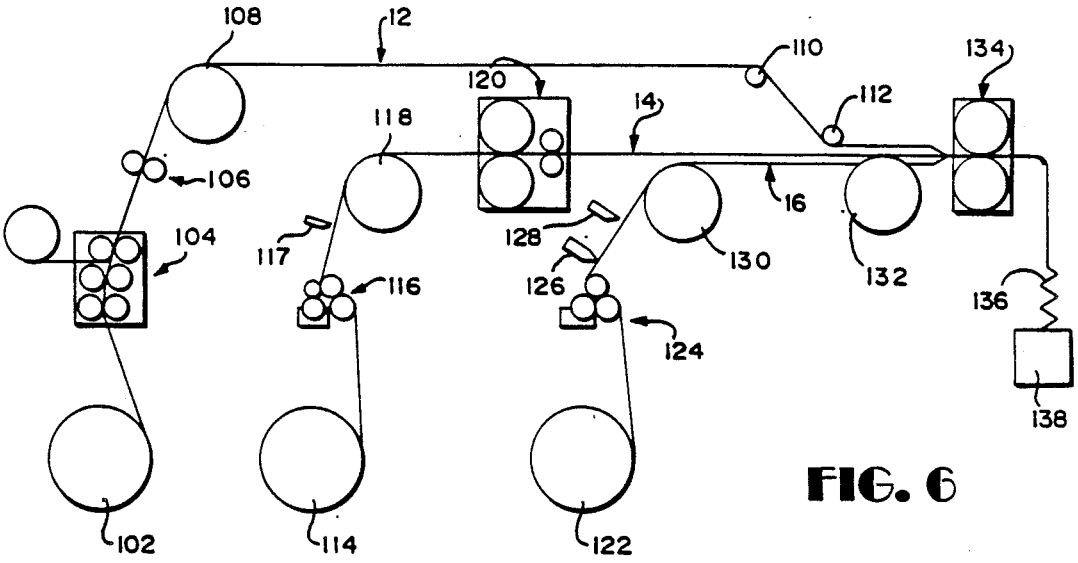
FIG. 6 is a schematic diagram of an exemplary process of producing the return mailer illustrated in FIG. 1.

Turning now to FIG. 6, there is shown a schematic diagram of apparatus 100 for carrying out the process for producing forms in accordance with an exemplary invention. Form part 12 originates in continuous form at a storage drum 102 and passes through a window die cut/patch application unit 104 followed by passage through a perforation unit 106 which forms the perforation 48. This first outer form part is then passed about a pinwheel control register 108 and guide rollers 110, 112 before being joined to the intermediate and second outer form parts as described below.

The intermediate form part 14 originates in continuous form at a storage drum 114 and passes upwardly through a spot print unit 116 which applies a self-contained carbonless spot to the upper lefthand corner of the intermediate form part 14 and in the address area 60 on part 14. The intermediate form part then passes a vertical glue strip applicator 117, about pinwheel control register 118 and thereafter through a die cut/vertical perforation unit 120 prior to being joined with the first and second outer form parts 12 and 16.

The second outer form part 16 originates in continuous form at a storage drum 122 and passes through pocket pasting unit 124, a rewettable glue strip applicator 126, and a vertical stream pasting unit 128 before passing about the pinwheel control register 130.

The three form parts 12, 14 and 16 are joined just downstream of another pinwheel 132, and the multi-layered continuous web is then passed through a transverse perforation unit 134 which defines the boundaries of integrally formed successive forms within the continuous web. The web may then be folded in a conventional zig-zag configuration 136 or in any other suitable manner, and stored in a box, crate, or the like for shipment to the customer who will then print the variable information on the form, upon confirming alignment of the mark 62 in the aperture 49.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A return mailer construction comprising a first outer part; an intermediate part; and a second outer part; said first outer part having a pair of side edges, an upper edge and a lower edge, and an address window formed therein, said window covered by a substantially transparent patch; a first perforation line extending between the upper and lower edges across the window and the patch to define a first separable portion of said first outer part, removable upon opening of the mailer construction.

2. The return mailer of claim 1 wherein said second outer part is formed with a second perforation line extending substantially parallel to, but laterally offset from, said first perforation line and defining a second separable portion of said second outer part.

3. The return mailer of claim 2 wherein said second outer part incorporates a return envelope flap portion, foldable over said first outer part after said intermediate envelope part is removed.

4. The return mailer of claim 3 wherein said return envelope portion is provided with a strip of rewettable adhesive for sealing said return envelope.

5. The return mailer of claim 1 wherein said first outer part is provided with an aperture adapted for alignment with a mark on said intermediate part.

6. The return mailer of claim 5 wherein a self-contained CF/CB area is provided underlying said mark.

7. The return mailer of claim 1 wherein a major portion of said window lies in said separable portion.

8. The return mailer of claim 1 and including a pair of gripping portions delineated on said first outer part along said side edges.

9. The return mailer of claim 1 wherein said intermediate part is formed with die cut upper and low edges which lie within said upper and lower edges of said first part.

10. The return mailer of claim 9 wherein said first and second outer parts are directly secured by adhesive along portions of said upper and lower edges.

11. The return mailer of claim 10 wherein said first outer part, said intermediate part and second outer part are secured along opposite, marginal edges.

12. The return mailer of claim 1 wherein at least a portion of a rear side of said first outer part is provided with a CB coating and at least a portion of a front side of said intermediate part is provided with a CF coating.

13. The return mailer of claim 12 wherein said intermediate form part is provided with a designated address area provided with a self-contained CF/CB coating.

14. A return mailer construction comprising first outer part, at least one intermediate part and a second outer part, wherein said first and second outer parts are used as both outgoing and return envelopes, said first outer part having a CB coating on at least a portion of an interior surface thereof, and said at least one intermediate form part having a CF coating on at least a portion of a front face thereof; said first outer form part having an address window formed therein covered by a substantially transparent patch, portions of said first outer part, said window and said transparent patch being separable from said first outer part upon opening of said mailer; said second outer part having a return envelope flap portion formed therein and foldable over at least a remaining portion of said address window in said first outer part.

15. The return mailer of claim 14 wherein a first perforation line extends between opposite edges of said first outer part and across said patch.

16. The return mailer of claim 15 wherein said second outer part is formed with a second perforation line extending substantially parallel to, but laterally offset from, said first perforation line and defining a separable portion of said second outer part.

17. The return mailer of claim 14 wherein said return envelope flap portion is provided with a strip of rewettable adhesive for sealing the return envelope.

18. The return mailer of claim 14 wherein said intermediate part is provided with a designated address area and said address area is provided with a self-contained CF/CB coating, underlying said window.

19. The return mailer of claim 18 wherein said first outer part is provided with an aperture adapted for alignment with a mark on said intermediate part to thereby insure alignment of said address area and said window.

20. The return mailer of claim 19 wherein a self-contained CF/CB area is provided on said intermediate part underlying said mark.

21. The return mailer of claim 14 and including a pair of gripping portions delineated on said first outer part along said side edges.

22. The return mailer of claim 14 wherein said intermediate part is formed with die cut upper and low edges which lie within said upper and lower edges of said first part.

23. The return mailer of claim 14 wherein said first and second outer form parts are directly secured by adhesive along portions of said upper and lower edges.

24. The return mailer of claim 14 wherein said first outer part, said intermediate part and second outer part are secured along opposite marginal edges.

* * * * *